United States Patent [19]

Blake

[11] 4,181,992

[45] Jan. 8, 1980

[54] REPOSITIONING A BED PATIENT

[76] Inventor: Sidney H. Blake, 8403 Clarinda Ave., Pico Rivera, Calif. 90660

[21] Appl. No.: 915,940

[22] Filed: Jun. 15, 1978

[51] Int. Cl.[2] ..... A47C 21/00

[52] U.S. Cl. ..... 5/443; 5/444

[58] Field of Search ..... 5/317 R, 327 R; 297/438, 439; 248/456, 460

[56] References Cited

U.S. PATENT DOCUMENTS

| | | | |
|---|---|---|---|
| 2,615,503 | 10/1952 | Enge | 297/438 |
| 2,911,657 | 11/1959 | Streeter | 5/327 R |
| 3,051,527 | 8/1962 | McKenna | 297/439 |
| 3,866,251 | 2/1975 | Pounds | 5/327 R |

FOREIGN PATENT DOCUMENTS

| | | | |
|---|---|---|---|
| 504495 | 7/1951 | Belgium | 248/456 |

*Primary Examiner*—Casmir A. Nunberg
*Attorney, Agent, or Firm*—Gene W. Arant

[57] ABSTRACT

A method and apparatus for repositioning a patient in a hospital bed after he has slid down towards the foot end of the bed. The apparatus is easily transported and used by a single nurse or attendant. The apparatus consists of two elongated rigid members, one being used to provide a fulcrum and the other being used as a lever.

5 Claims, 8 Drawing Figures

Fig. 4.
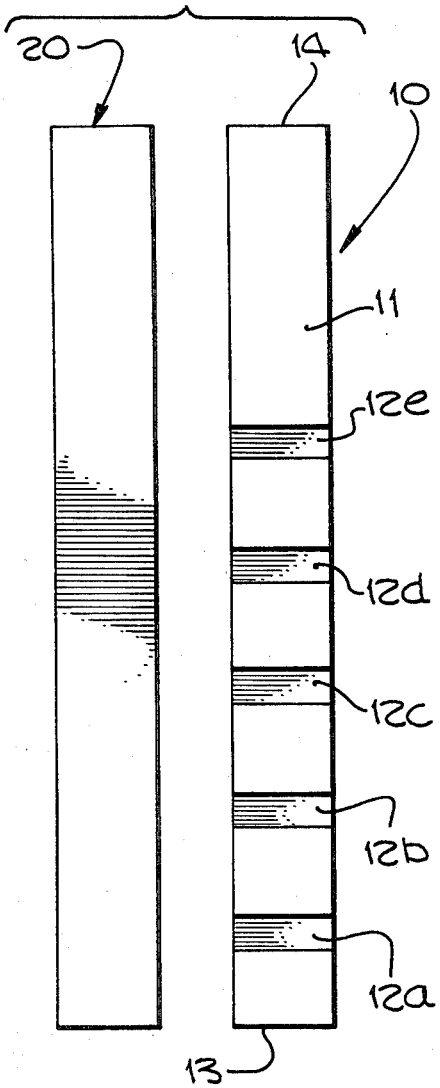
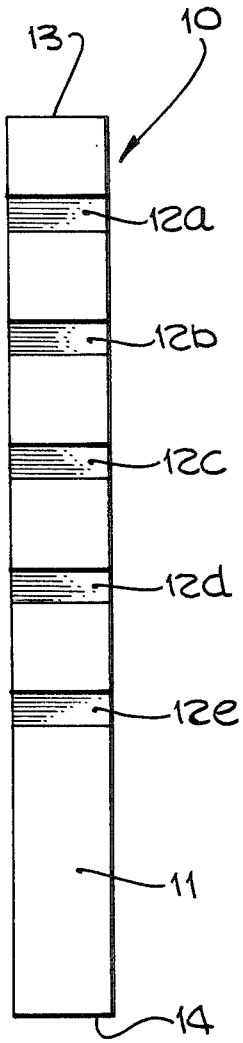
Fig. 5.
Fig. 6.
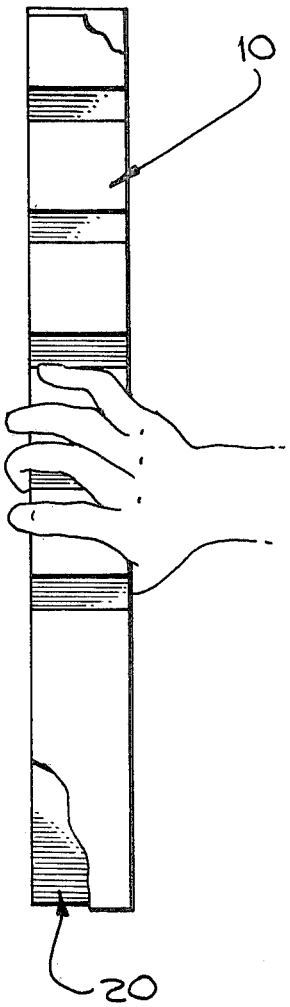
Fig. 7.
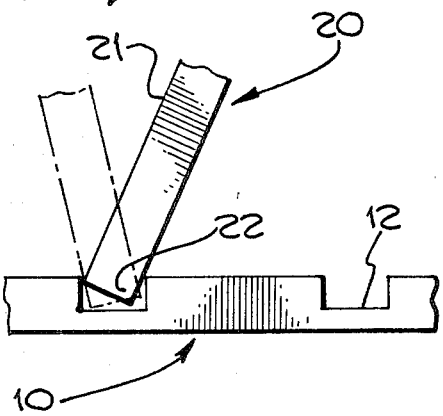
Fig. 8.
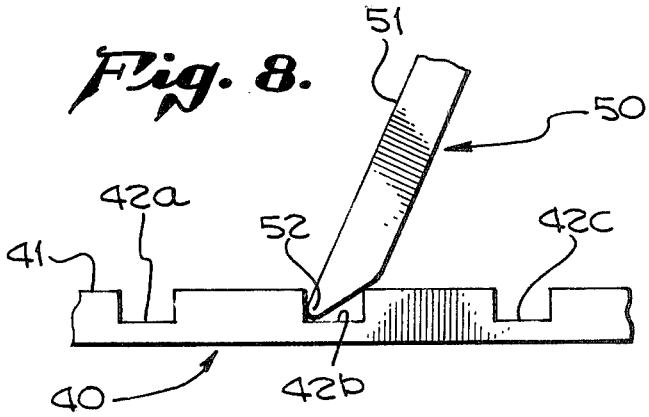

REPOSITIONING A BED PATIENT

PRIOR ART

Among the prior art patents are the following:
U.S. Pat. No. 667,260: Stetson
U.S. Pat. No. 1,354,750: Towsend
U.S. Pat. No. 1,694,095: Moulin
U.S. Pat. No. 2,952,855: Zuti
U.S. Pat. No. 3,866,251: Pounds

BACKGROUND OF THE INVENTION

A problem that commonly arises in caring for a patient in a hospital bed is that the patient often needs to be repositioned in the bed, and requires assistance for that purpose. The conventional hospital bed is provided with a head end portion that can be selectively raised or lowered. It is very convenient for the patient to have the head end of the bed raised when he wishes to eat, to read, or just to look around. Unfortunately, however, the raised position of the bed usually causes the patient to slide downward so that his feet come too close to the foot end of the bed. It then becomes necessary to reposition the patient in the opposite direction.

Depending upon the nature of his illness or disability, it often happens that the patient may not have sufficient strength and agility to reposition himself when the need arises. This is particularly true if he is suffering from a stroke or other crippling disease. It then generally requires two nurses or hospital assistants to reposition the patient.

Alternatively, the prior art has shown rather complex apparatus that may be used to assist in repositioning a bed patient. By utilizing such apparatus it may be possible for a single nurse or assistant to accomplish the result. However, the prior art apparatus has been expensive and complicated, as well as unattractive in appearance, and hence so far as known to the present applicant none of the types of apparatus shown in the prior art patents have come into popular usage.

The object of the present invention is to provide a method and apparatus for repositioning a bed patient, which are very simple and also very economical, but yet effective.

Another object of the present invention is to provide a method and apparatus for repositioning a bed patient which can be accomplished by a single nurse or attendant.

SUMMARY OF THE INVENTION

The present invention provides an apparatus which is simple, inexpensive, and easy to use. It can be operated by a single nurse or attendant.

The apparatus of the present invention consists of two relatively flat rigid members each of which has a length of about two feet. One member has a plurality of retaining means on one side. This first member is positioned on top of the bed with one end of the member abutting against the footboard of the bed, and the retaining means being uppermost. The retaining means are longitudinally spaced along the length of the first member.

The second elongated rigid member is used as a lever. It is placed in a substantially vertical position with its lower end engaging a selected one of the retaining means on the first member. It is then used as a lever by the nurse or assistant, for the purpose of providing support to the under surface of one foot of the patient.

According to the method of the present invention the nurse or assistant uses one hand on the upper end of the lever to hold the lever in place. At the same time the other hand is used to lift one foot of the patient and hold that foot in its desired position against the flat surface of the lever. The patient then uses his own energy in order to straighten out his knee and thereby produce a pushing action which repostions him upwards in the bed.

DRAWING SUMMARY

FIG. 4 is a top plan view of the two boards used in the preferred embodiment of the invention;

FIG. 5 is a top plan view of the fulcrum bar or base board in reversed position;

FIG. 6 shows both the fulcrum bar and the base board being carried in one hand of a nurse or hospital assistant;

FIG. 7 is a fragmentary elevation view illustrating the pivoting action of the lever; and FIG. 8 is a view similar to FIG. 7 but showing a modified form of the apparatus of the present invention.

PREFERRED EMBODIMENT

Reference is now made to FIGS. 1 through 7, inclusive, of the drawings which illustrate the presently preferred form of apparatus according to the present invention, and its method of use.

Figure 1:
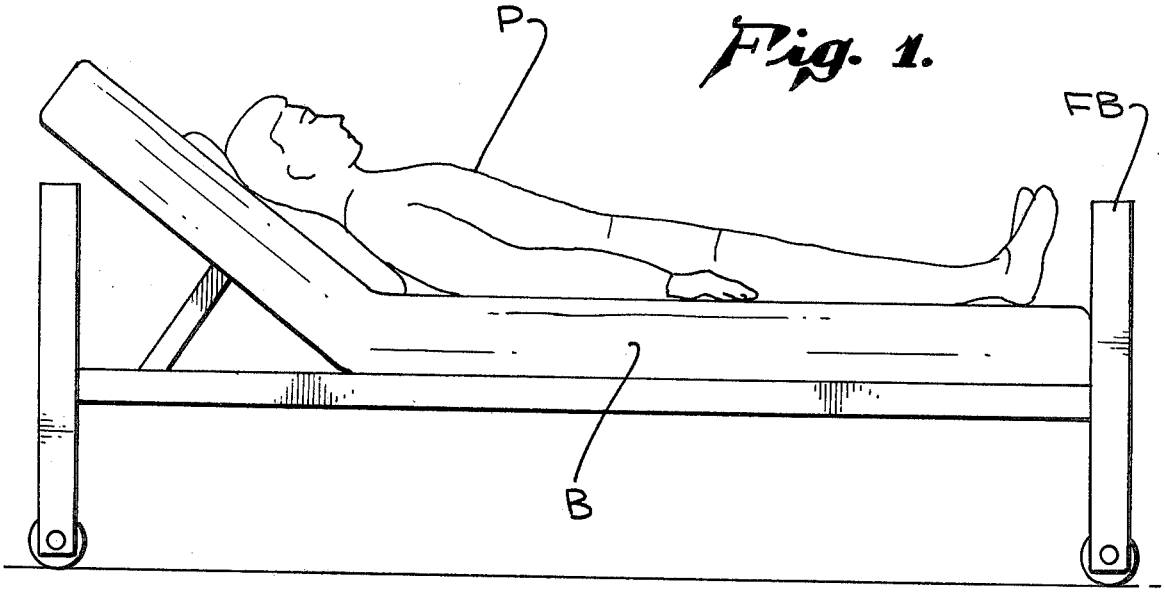
FIG. 1 is a side elevation view of a patient lying in a hospital bed.

FIG. 1 shows a conventional hospital bed B upon which a patient P is resting. The bed is equipped with a foot board FB. As shown in this figure the head portion of the bed has been raised in order to raise the head and shoulders of the patient. The raised position of the head of the bed has caused the patient to slide towards the foot of the bed.

Figure 2:
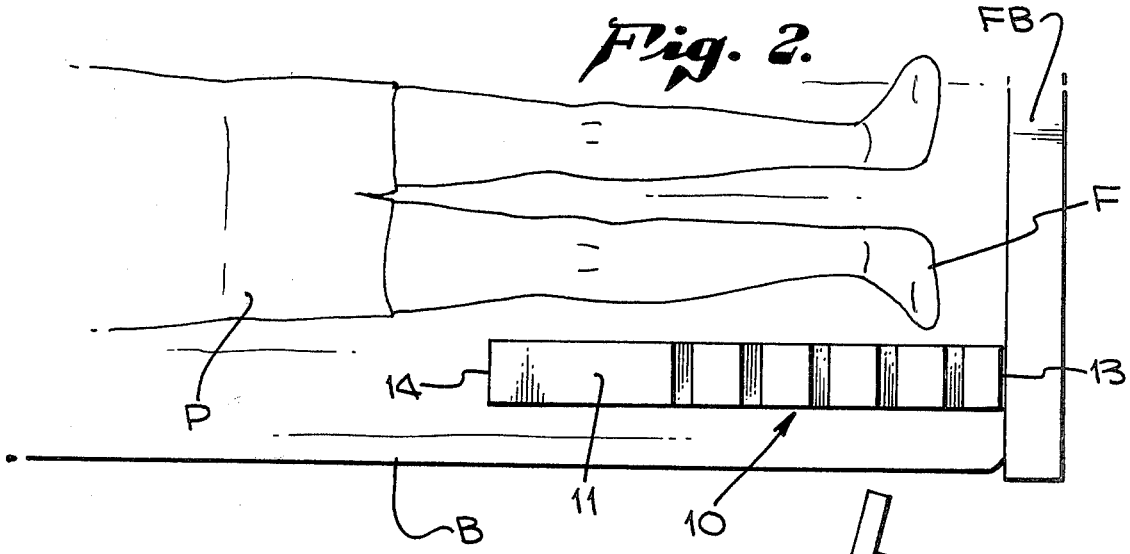
FIG. 2 is a top plan view of the bed and the legs of the patient after the fulcrum bar of the present invention has been positioned on the bed surface.

As shown in the lower part of FIG. 2 the base board 10 of the present invention has been positioned beside the right leg of the patient on the surface of the bed. Before further describing the mode of use of the apparatus, the apparatus itself will be described.

Figure 3:
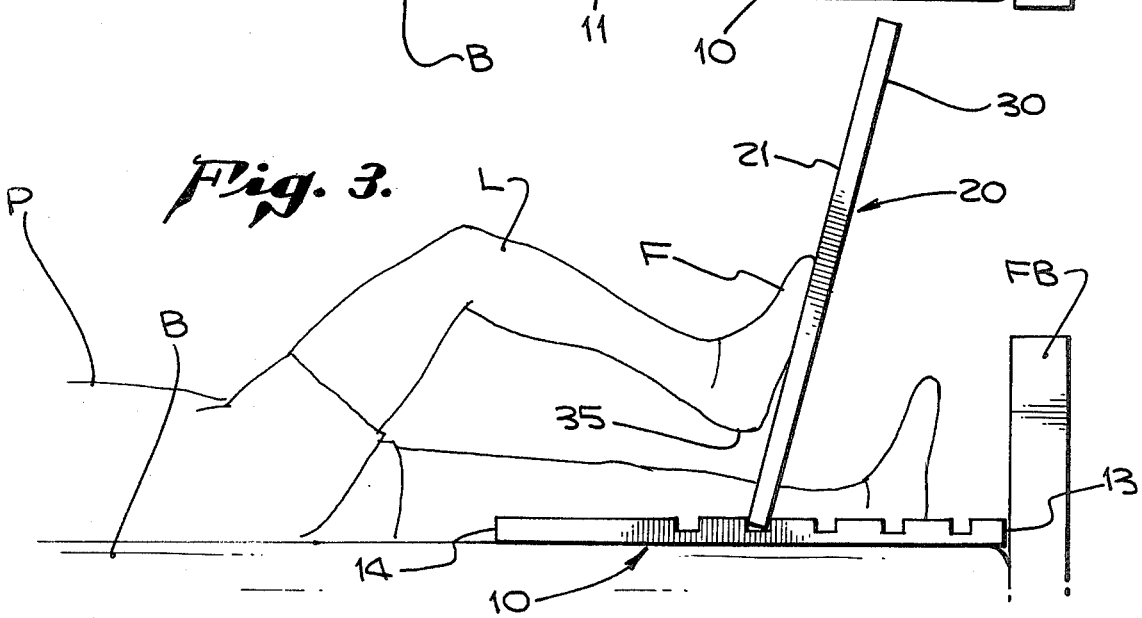
FIG. 3 is a side elevation of the patient and bed, showing the apparatus of the present invention in use.

As shown in FIGS. 3 and 4 the preferred form of apparatus according to the present invention includes a base board or fulcrum bar 10 and a power bar or lever 20. Each of the members 10, 20 is a piece of wood about two feet long, about three inches wide, and having a thickness of about three quarter inch. The member 20 is simply a plain board having smooth surfaces. The member 10 is identical to member 20 except for the plurality of notches 12*a* . . . 12*e* formed in its upper surface 11.

More specifically, as best seen in FIGS. 3 and 7 each of the notches 12*a* . . . 12*e* is a rectangular notch having vertical walls. The depth of the notch is about half or more of the thickness of base member 10. The width of each notch, measured along the length of base board 10, is somewhat greater than the thickness of the lever or power bar 20. Thus, if member 20 has a thickness of 11/16 inches, each notch 12 has a width of 14/16 inches. This extra width of each notch permits a pivoting action of the lever or power bar as shown in FIG. 7.

The nurse of hospital attendant can carry both the members 10, 20 very easily in one hand as shown in FIG. 6. Upon arriving at the bed the attendant first places the base board 10 upon the surface of the bed with its notched surface 11 facing upward, with one end 13 of the base board abutting the foot board FB, and the other end 14 of the base board facing towards the head end of the bed. The next step is to place the lever or power bar in a substantially vertical position and then insert its lowermost end 22 into a selected one of the notches 12. Power bar 20 is held in approximately the position shown in FIG. 3. The hospital assistant grasps the upper end of the power bar by means of his right hand as indicated with the arrow 30 in FIG. 3.

Then the attendant uses his left hand to place under the right heel of the patient as shown by arrow 35. The patient is asked to raise his right leg L. The attendant, using his left hand as indicated at arrow 35, manipulates the leg and foot of the patient so that the patient's foot rests at a desired elevation upon the flat surface 21 of power bar 20, which is comfortable for his leg.

Then the attendant slides the patient's foot downward on surface 21 for power bar 20 to prepare the patient for the next step. The next step is for the patient to straighten out his right leg L, in order to produce a pushing action that will push his entire body towards the head end of the bed. As shown in FIG. 3 the head portion of the bed remains flat at this time.

The position in which power bar 20 is held by the attendant is only approximately indicated in FIG. 3. The power bar is tilted away from the patient to provide a comfortable support for his foot. The precise angle is determined by experience, for the mutual convenience and benefit of both the patient and the attendant. Whatever angle is selected, the attendant holds the power bar firmly in place while the patient straightens his leg. It is also preferred that the attendant twist the power bar in a slight pivoting movement toward the head of the bed as a means of gently pushing the patient in that direction.

Throughout this procedure the attendant securely holds the patient's foot at the heel. This not only prevents the foot from slipping off one side of the power bar but also provides proper control of the elevation of the patient's foot.

As presently illustrated the base board 10 is provided with only five notches 12*a* . . . 12*e*, inclusive. This provides only five different distances from the footboard FB at which the lower end 22 of power bar 20 may be pivotally supported. However, these notches are nonsymmetrical with regard to the longitudinal center of base board 10. Therefore, as shown in FIG. 5 the base board may be reversed, positioning its other end 14 in abutting engagement with foot bard FB, and this action provides a different set of five positions where the lower end of the power bar may be pivotally supported, as the position of the patient advances, towards the head of the bed.

ALTERNATE FORMS

While the presently preferred form of the invention is made from two wooden boards it will of course be understood that the elongated, relatively flat rigid members may if desired be made from other materials.

In the preferred embodiment notches are formed in the base board 10 to provide pivotal support for the lower end of power bar 21. However, other types of retaining means may be used if desired. For example, the lower end of power bar 20 may be provided with a pair of protruding bolts or nails, and a corresponding pair of holes may be drilled in the base board 10 which will receive the bolts or nails in pivotal relationship therewith. As a further alternative, base board 10 may be simply a plain board on which small cleats or crosspieces are nailed to provide the retaining means.

In the modified form of the apparatus as shown in FIG. 8 the base board 14 has a flat upper surface 41 in which slots 42*a*, 42*b*, 42*c* . . . are formed. These slots or notches are rectangular as in the preferred embodiment. The power bar or lever 50 has its lower end 52 beveled at an angle, rather than cut square, so as to expedite the pivoting movement of the power bar but without sacrificing the necessary longitudinal support from the base board.

The invention has been described in considerable detail in order to comply with the patent laws by providing a full public disclosure of at least one of its forms. However, such detailed description is not intended in any way to limit the board features or principles of the invention, or the scope of patent monopoly to be granted.

What is claimed is:

1. In the art of repositioning a patient in a hospital bed after he has slid down towards the foot board of the bed, the method comprising the steps of:

selecting a first elongated relatively flat rigid member having a plurality of longitudinally spaced retaining means on one side thereof;

positioning said first member lengthwise upon the surface of the bed with one end of said member engaging the foot board and said retaining means being upwardly disposed;

selecting a second elongated rigid member having a flat longitudinal surface thereon, and having one end adapted to removably engage a selected retaining means on said first member;

placing said second member in a substantially vertical position spaced away from the foot board, with said flat surface facing away from the foot board, and with said one end removably engaging a selected one of said retaining means; and then raising one foot of the patient, while the patient's knee is bent, and placing the foot upon said flat surface so that the patient, by straightening his leg, may move himself towards the head of the bed.

2. Portable apparatus for repositioning a patient in a hospital bed, comprising:

first and second elongated relatively flat rigid members, each having a length of about two feet;

said first member having a plurality of longitudinally spaced retaining means on one side thereof, and being adapted to be horizontally disposed upon the bed with said one side thereof facing upwardly;

said second member having on one side thereof a smooth flat surface adapted to support one foot of the patient thereon, said second member also having one end adapted to be removably engaged with a selected one of said retaining means on said first member; and said second member being pivotal relative to said first member without detaching said one end thereof from said retaining means.

3. Apparatus as in claim 2 wherein each of said rigid members is a wooden board, said first board has a plurality of transversely extending notches therein forming said retaining means, and the width of each of said notches is substantially greater than the thickness of said one end of said second board, thereby permitting said pivotal movement to take place.

4. Apparatus as in claim 2 wherein said retaining means are bidirectionally operable and are non-symmetrical relative to the longitudinal center of said first member, whereby said first member may be placed with one end thereof in abutting relationship to the foot of the bed to provide one set of positions for supporting said second member or may be reversed to provide a second set of positions.

5. Apparatus as in claim 3 wherein said retaining means are bidirectionally operable and are spaced non-symmetrically relative to the longitudinal center of said first member, whereby said first member may be placed with one end thereof in abutting relationship to the foot of the bed to provide one set of positions for supporting said second member or may be reversed to provide a second set of positions.

* * * * *